United States Patent [19]

Jung et al.

[11] 4,239,402

[45] Dec. 16, 1980

[54] DETACHABLE WIRE MATRIX PRINT HEAD MOUNTING STRUCTURE

[75] Inventors: Friedrich Jung, Erlangen; Wilfried Rettke, Nuremberg, both of Fed. Rep. of Germany

[73] Assignee: Triumph Werke Nurnberg A.G., Nuremberg, Fed. Rep. of Germany

[21] Appl. No.: 974,225

[22] Filed: Dec. 29, 1978

[30] Foreign Application Priority Data

Jan. 5, 1978 [DE] Fed. Rep. of Germany ..... 2800390

[51] Int. Cl.[3] ..... B41J 3/12; B41J 29/00

[52] U.S. Cl. ..... 400/175; 400/124; 400/692

[58] Field of Search ..... 400/119, 120, 124, 320, 400/692, 175; 101/93.05; 248/499, 505

[56] References Cited

U.S. PATENT DOCUMENTS

| | | | |
|---|---|---|---|
| 2,490,869 | 12/1949 | Heim | 248/505 X |
| 3,921,780 | 11/1975 | Gentzlinger et al. | 400/175 |
| 3,960,255 | 6/1976 | Bisson et al. | 400/120 |
| 3,963,108 | 6/1976 | Steinhausser | 400/124 |

FOREIGN PATENT DOCUMENTS

| | | | |
|---|---|---|---|
| 984987 | 3/1965 | United Kingdom | 248/499 |

*Primary Examiner*—Paul T. Sewell

*Attorney, Agent, or Firm*—Joseph R. Spalla

[57] ABSTRACT

A wire matrix print head is configured for detachable mounting in a complementary shaped support and held thereto by a spring device which urges the complementary surfaces of the head and its support in secure contact with one another.

1 Claim, 3 Drawing Figures

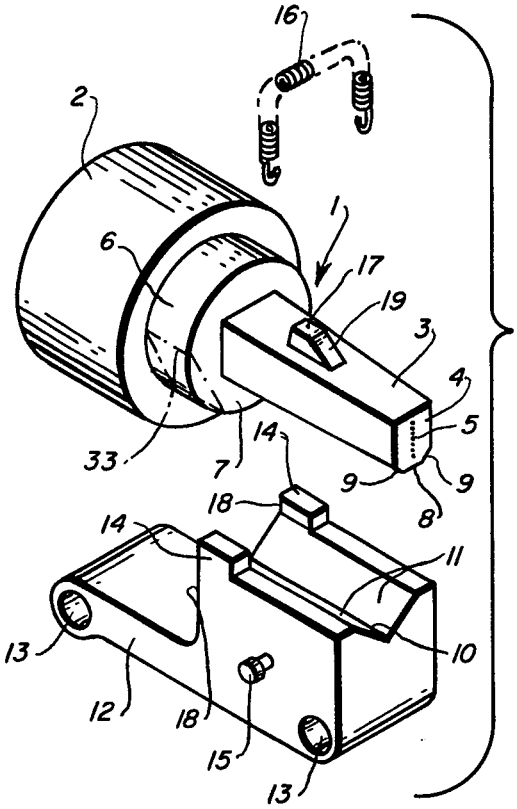
Fig_1
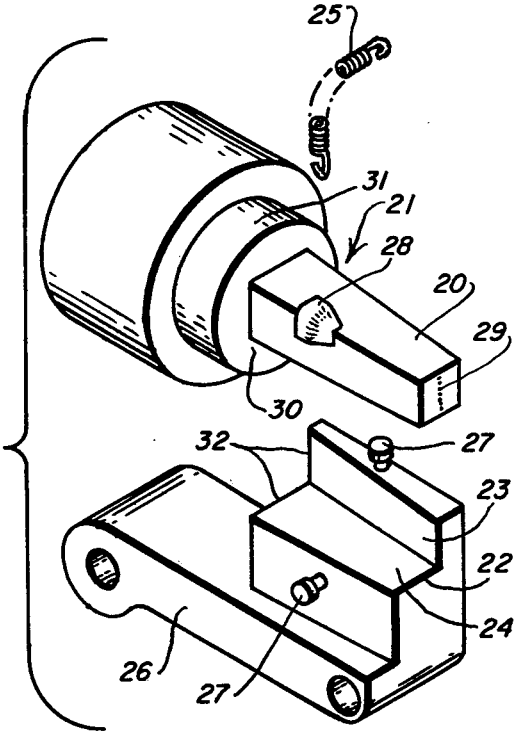
Fig_3
Fig_2
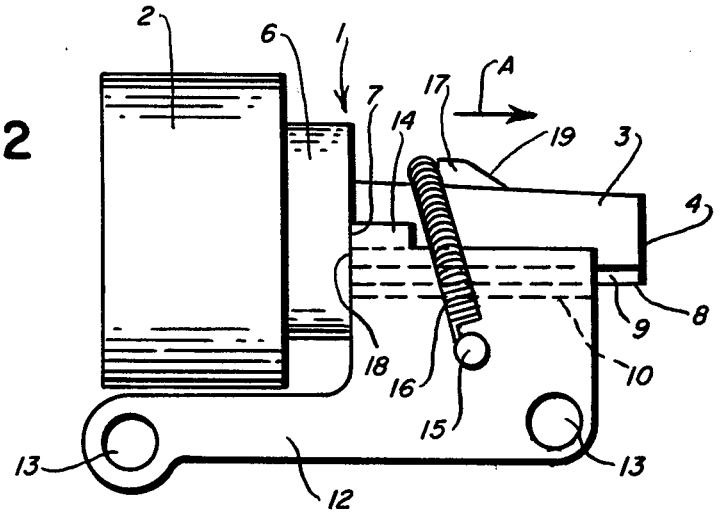

DETACHABLE WIRE MATRIX PRINT HEAD MOUNTING STRUCTURE

This invention relates to a detachable matrix print head mounting structure; more particularly, it relates to matrix print head mounting structure wherein the print head and its support or carrier structure have complementary surfaces at right angles to one another; and specifically, to spring means for securing a matrix print head and its complementary shaped support structure securely together with all mating surfaces under pressure contact.

Wire or needle matrix printing heads, since the wire ends are subject to wear and must be replaced, require that the heads be easily mounted and detachable from their support or carrier structure without the aid of a mechanic. German Utility Model Pat. No. 7,723,472 shows structure for releasably attaching a needle printing head to a support characterized by a number of expensive parts which require fairly close tolerances in their production. With this structure, it is not entirely assured that the printing head is absolutely immovable, because it is inserted in bores by means of some pins and, therefore, necessarily has some play. This is disadvantageous in particular when a printing head thus secured is used in a printer which is to print in both directions, i.e. from left and right and from right to left.

In accordance with this invention, the print head and its support or carrier are formed with complementary surfaces and held together by a spring which urges contacting surfaces together.

An object of the invention is to provide mounting and support structure for a matrix print head which is easy and cheap to manufacture and which securely positions the printing head regardless of the typing direction.

A further object of the invention is to provide mounting and support structure for a matrix print head which allows the print head to be detachably mounted in a facile manner without the use of tools.

Other objects and many of the attendant advangtages of this invention will be readily appreciated as the same becomes better understood by reference to the following detailed description when considered in connection with the accompanying drawing in which like reference numerals designate like parts throughout the Figures thereof and wherein:

FIG. 1 is an exploded perspective view of an arrangement according to the invention;

FIG. 2 is a side view of the parts of FIG. 1 assembled; and

FIG. 3 is an exploded perspective view of another configuration or embodiment of the parts.

Referring now to the drawing, there is shown in FIG. 1, a needles printing head generally designated by reference numeral 1 which consists of a round magnet housing 2 and a needle guide 3, at the mouthpiece 4 of which printing needles 5 protrude. The needle guide 3 is firmly connected with the magnet housing 2 by a flange 6, which has a face 7. The underside of the needle guide 3 has a profile 8 which has beveled surfaces 9.

A complementary or counter-profile 10 is defined by inclined upwardly directed surfaces 11 of a support generally designated by reference numeral 12, which may be designed in the form of a carrier or slide movable along the printing line. For this purpose, the support 12 is provided with bores 13, by means of which it can be set on guide rails. The support 12 also is formed with spaced upstanding seats 14 designed to accomodate the guide 3. Hook-on studs 15 on opposite sides of the support 12 serve to anchor the ends of an extension spring 16 which is stretched from one hook-on stud 15 to the other hook-on stud 15 on the other side of support 12. Thus, after placement of the needle guide profile 8 of the printing head 1 in the counterprofile 10 of the support 12, the spring 16 will resiliently embrace the needle guide 3.

As shown in FIG. 1, the spring 16 spans a nose 17 provided on the needle guide 3. As can be seen from FIG. 2, the position of the hook-on studs 15 relative to the position of the nose 17 when the printing head 1 is mounted is such that by means of nose 17 spring 16 pulls the printing head 1 in the direction of arrow A. In so doing, face 7 of flange 6 on the printing head 1 bears against the rearward faces 18 of the seats 14 on the support 12. To facilitate the insertion of the printing head 1 into the support or carrier 12, the front face 19 of a nose 17 is beveled so tht upon insertion in the direction of arrow A, the spring 16 can be pulled over nose 17 and can then snap onto the needle guide 3.

In the embodiment shown in FIG. 3, the needle guide 20 of the printing head 21 is of square or rectangular cross-section. The counter-profile 22 of the support consists of the two faces 23 and 24, against which the needle guide 20 is pulled under the action of the extension spring 25. On the support 26 again two hook-on studs 27 for spring 25 are provided. In the mounted state of the printing head 21, the hook-on studs 27 again lie a little in front of nose 28 of the needle guide 20 toward the printing needle end 29. Thus also in this arrangement the face 30 of flange 31 of the needle printing head 21 is pressed against the faces 32 of the counter-profile 22, and owing to which the needle printing head 21 is also securely positioned. Also in this embodiment, nose 28 may be beveled so that spring 25 can easily snap over it.

As the drawings show, a simple attachment can thus be provided according to the invention which, apart from the spring 16, requires no additional fastening elements. But it is easily possible, by lifting the spring 16, to take the printing head 1 out of the support 12 counter to the arrow A direction and to exchange it for another. The electrical connections between the printing head 1 and the other parts of the device can be broken by means of a known plug connection.

In certain needle printers, it may be expedient, for better stabilization of the printing head, to cut plane faces 33 on flange 6, as is indicated in dash-dot lines in FIG. 1. When these faces make contact on corresponding counter-faces of support 12, a seating of the printing head 1 on its support 12 on a still larger area is obtained. This is desirable especially when a large and hence heavy printing head 1 is involved.

The invention claimed is:

1. Mounting structure for securely removably holding a matrix print head with its planar printing face opposite a parallel printing plane comprising a support structure having a profile defined by a first planar surface parallel to said printing face and intersecting planar surfaces at right angles to said first planar surface, said matrix print head having a profile complementary to the profile of said support structure whereby said matrix print head is supported against movement in the direction of said parallel printing plane by engagement with said first planar surface of said support structure and against lateral movement by said intersecting planar surfaces of said support structure, anchor studs extending outwardly from said support means, said matrix print head having an abutment located at a distance from said planar printing face greater than the distance of said anchor studs from said planar printing face, and a spring having its ends secured to said anchor studs and resiliently embracing said matrix print head to urge said matrix print head into mating engagement with said intersecting planar surfaces of said support structure, and said spring acting against said abutment on said matrix print head to urge said matrix print head toward said first planar surface on said support structure.

* * * * *